US006232943B1

(12) United States Patent
Tagawa et al.

(10) Patent No.: US 6,232,943 B1
(45) Date of Patent: May 15, 2001

(54) LIQUID CRYSTAL DISPLAY

(75) Inventors: Akira Tagawa, Kashiwa; Keisaku Nonomura, Nara, both of (JP); Paul Bonnett, Littlemore; Michael John Towler, Botley, both of (GB)

(73) Assignees: Sharp Kabushiki Kaisha, Osaka (JP); The Secretary of State for Defence in Her Britannic Majesty's Government of the United Kindgom of Great Britain and Northern Ireland, Hants (GB)

( * ) Notice: Subject to any disclaimer, the term of this patent is extended or adjusted under 35 U.S.C. 154(b) by 0 days.

(21) Appl. No.: 09/040,805

(22) Filed: Mar. 18, 1998

(30) Foreign Application Priority Data

Mar. 25, 1997 (JP) ..... 9-072198

(51) Int. Cl.[7] ..... G09G 3/36
(52) U.S. Cl. ..... 345/97; 345/89; 345/96
(58) Field of Search ..... 349/143, 141, 349/41, 94, 97; 345/86–100

(56) References Cited

U.S. PATENT DOCUMENTS 5,260,699 * 11/1993 Lister et al. ..... 345/97
5,515,073 * 5/1996 Surguy ..... 345/97
5,568,163 * 10/1996 Okumura ..... 345/100
5,638,195 * 6/1997 Katakura et al. ..... 349/143
5,793,347 * 8/1998 Mugridge ..... 345/94
5,905,556 * 5/1999 Suzuki et al. ..... 349/141
5,986,724 * 11/1999 Akiyama et al. ..... 349/41

FOREIGN PATENT DOCUMENTS 0526095 2/1993 (EP) .
6-258615 9/1994 (JP) .

OTHER PUBLICATIONS

European Search Report for Application No. 98302002.5–2205–; Dated Jul. 17, 1998.

* cited by examiner

*Primary Examiner*—Steven Saras
*Assistant Examiner*—Uchendu O. Anyaso
(74) *Attorney, Agent, or Firm*—Renner, Otto, Boisselle & Sklar

(57) ABSTRACT

Given a natural number "n", then, in the first frame of continuous two frames, strobe pulses of opposite polarities are applied respectively to a scanning electrode $L_{2n-1}$ in a (2n−1)'th line and a scanning electrode $L_{2n}$ in a 2n'th line during a selection period. In the second frame, strobe pulses of opposite polarities are applied respectively to the scanning electrode $L_{2n}$ in the 2n'th line and a scanning electrode $L_{2n+1}$ in a (2n+1)'th line during a selection period.

4 Claims, 9 Drawing Sheets

LIQUID CRYSTAL DISPLAY

FIELD OF THE INVENTION

The present invention relates to gray-scale display of a liquid crystal display, and more particularly, to gray-scale display of a liquid crystal display, such as a TFT liquid crystal panel, an STN liquid crystal panel, and a ferroelectric liquid crystal panel, whose gray-scale display characteristics vary considerably with a change in temperature.

BACKGROUND OF THE INVENTION

A liquid crystal display has become widely available as an information display because of its advantages, such as light weight, thinness, and low power consumption. On the other hand, full gray-scale display is demanded on the display device side as a volume of information transmission media increases or processing ability of computer hardware improves. Thus, the full gray-scale display is essential to the liquid crystal display as well to achieve further widespread use.

A TFT (Thin Film Transistor) type liquid crystal display, known as one type of the liquid crystal displays, is provided with thin film transistors for individual pixels which form a display, and the gray-scale state of the liquid crystal is controlled by these transistors. Generally, line electrodes are scanned per line to open the gate of each transistor provided for individual pixels belonging to the line being scanned, and the half-tone is controlled with a peak value of a voltage applied to the source (drain) at the scanning.

On the other hand, a ferroelectric liquid crystal display has been receiving attention because the ferroelectric liquid crystal has a memory property (bistability), and therefore, it can attain high-quality display without adding active elements such as transistors, but by adopting a so-called passive matrix arrangement.

However, since the ferroelectric liquid crystal can switch between only two states in effect, it has been said that it is difficult to realize the half-tone display on the liquid crystal display using the ferroelectric liquid crystal. To eliminate this problem, the use of the dither method (spacial dividing method, temporal dividing method), and a method (analog method) of letting two switching states coexist and the like have been under active study.

However, unlike the other types of displays, the temperature dependency of the liquid crystal material characteristics is large in the liquid crystal display, and therefore, there rises a problem that its gray-scale display ability is affected considerably by the circumstances in which the display is used, especially temperature. This problem becomes particularly noticeable in a ferroelectric liquid crystal display having an unstable half-tone display state (coexistence of two stable states), and whose liquid crystal material characteristics has very large temperature dependency.

Also, the ferroelectric liquid crystal display often causes uneven display due to the characteristic distribution in the panel or the like. In other words, the uneven display occurs due to the variation in temperature and variation of characteristics in the panel. Especially in analog method which uses coexisting two switching states, thickness variation of liquid crystal layer (or cell spacing) gives large variation of characteristics in the panel. The coexisting states are quite sensitive to thickness variation of cell spacing.

A method of solving the above problem in the display (ferroelectric liquid crystal display and the like) having a bistable state is disclosed in Japanese Laid-open Patent Application Nos. 27719/1993 (Tokukaihei No. 5-27719) and 27720/1993 (Tokukaihei No. 5-27720).

In a liquid crystal display disclosed in the above publications, as shown in FIG. 8, one pixel P is divided into two sub-pixels $P_A$ and $P_B$. Of these two pixels $P_A$ and $P_B$, the sub-pixel $P_A$ is fully written into a first stable state with a first writing pulse, after which it is written into a second stable state corresponding to a display scale with a second writing pulse, while the sub-pixel $P_B$ is fully written into the second stable state with the first writing pulse, after which it is written into the first stable state corresponding to a display scale with the second writing pulse. In other words, the sub-pixels $P_A$ and $P_B$ respond optically in the opposite manners to the identical writing pulses.

FIG. 9 illustrates the optical response characteristics (transmittance) of the sub-pixels $P_A$ and $P_B$ forming one pixel in response to the writing pulse. In the drawing, Graph a shows the characteristics of the sub-pixel $P_A$ and Graph b shows the transmittance of the sub-pixel $P_B$. Also, in the drawing, Graphs a' and b' indicated as a broken line respectively show the transmittance of the sub-pixels $P_A$ and $P_B$ when the ambient temperature has changed.

As it is understood from the drawing, the optical response characteristics, that is, transmittance in response to a voltage, of the sub-pixels $P_A$ and $P_B$ shift in the directions opposite to each other as the temperature changes. To be more specific, the comparison between Graphs a and a' reveals that the transmittance of the sub-pixel $P_A$ shifts in an increasing direction as the temperature changes. On the other hand, the comparison between Graphs b and b' reveals that the transmittance of the sub-pixel $P_B$ shifts in a decreasing direction as the temperature changes.

According to the conventional method, for example, to achieve half-tone transmittance $I_4$ at the pixel P, a voltage $V_A$ and a voltage $V_B$ are applied to the sub-pixels $P_A$ and $P_B$, respectively. Then, the sub-pixel $P_A$ shows the transmittance $I_4$ while the other sub-pixel $P_B$ also shows the transmittance $I_4$, thereby making it possible to attain the desired transmission $I_4$ at the pixel P as a whole.

When the optical response characteristics have shifted with a change in temperature or the like, as is understood from FIG. 9, the sub-pixel $P_A$ attains transmittance $I_4+\Delta I$ while the sub-pixel $P_B$ attains transmittance $I_4-\Delta I$ upon application of the identical voltages $V_A$ and $V_B$, respectively. Thus, the pixel P composed of the sub-pixels $P_A$ and $P_B$ attains the transmittance $I_4$ as a whole as it does in the above case. In other words, according to the conventional method, the variance in the optical response characteristics caused by the variance in temperature or the variance of characteristics can be compensated.

However, according to the method disclosed in aforementioned Japanese Laid-open Patent Application Nos. 27719/1993 (Tokukaihei No. 5-27719) and 27720/1993 (Tokukaihei No. 5-27720), one pixel must be divided to, for example, two sub-pixels. Thus, if the resolution of the conventional display is to be secured, for example, the sub-pixels, half in size and double in number compared with the pixels in the conventional display, are necessary.

Thus, finer electrode work is demanded compared with the conventional display, which causes the cost to increase. Also, since the number of the electrode outputs of the scanning electrodes is increased twice, the two-fold scanning drivers are necessary, which also causes the cost to increase.

If the second writing pulse is applied to the two sub-pixels simultaneously to shorten the selection period when the stable state corresponding to a certain half-tone is written with the second writing pulse, the two sub-pixels demand not only their own line electrodes, but also their own column electrodes. Thus, the electrodes demand very fine work; moreover, the number of the information signal drivers must be increased twice.

SUMMARY OF THE INVENTION

It is therefore an object of the present invention to provide a liquid crystal display which can realize stable gray-scale display without increasing the costs.

To solve the above problem, a liquid crystal display of claim 1 is a liquid crystal display, in which each pixel can be in at least one half-tone display state in addition to a light state and a dark state, characterized in that:

given a natural number "n", then, of continuous first and second frames, a scanning electrode in a (2n−1)'th line and a scanning electrode in a 2n'th line are simultaneously selected in the first frame, and the scanning electrode in the 2n'th line and a scanning electrode in a (2n+1)'th line are simultaneously selected in the second frame; and scanning voltages are applied respectively to the simultaneously selected two scanning electrodes during a selection period, the scanning voltages shifting optical response characteristics of pixels on the respective scanning electrodes to an identical data voltage in directions opposite to each other in response to a change in temperature.

According to the above arrangement, scanning voltages are applied respectively to the simultaneously selected two scanning electrodes during a selection period, and the scanning voltages shift the optical response characteristics of pixels on the respective scanning electrodes to an identical data voltage in directions opposite to each other in response to a change in temperature.

In other words, in response to the change in temperature, for example, the optical response characteristics shift in such a manner to increase the transmittance of the pixels on one of the two scanning electrodes, while the optical response characteristics shift in such a manner to decrease the transmittance of the pixels on the other scanning electrode.

Accordingly, the shifts of the optical response characteristics caused by the change in temperature are cancelled out on the simultaneously selected two neighboring scanning electrodes. Thus, variance of the optical response characteristics of the liquid crystal display in response to a change in ambient temperature or the like can be suppressed, thereby making stable half-tone display possible. In the same manner, other characteristics distribution (e.g. thickness variation of liquid crystal layer) in the panel may be able to be cancelled.

Note that, however, the actual resolution in one frame is reduced to half of the original resolution by sequentially selecting two scanning electrodes simultaneously. To eliminate this problem, in the first frame, for example, two scanning electrodes in a combination of the first and second lines, third and fourth lines, fifth and sixth lines, . . . , are selected simultaneously, and in the second frame, two scanning electrodes in a different combination of the second and third lines, fourth and fifth lines, sixth and seventh lines, . . . , are selected simultaneously.

In this manner, by changing the combination of the simultaneously selected two scanning electrodes in each frame, the display resolution visible to human eyes can be improved without increasing the number of the electrodes. Consequently, it has become possible to realize satisfactory gray-scale display which causes no flicker.

A liquid crystal display of claim 2 is the liquid crystal display set forth in claim 1, further characterized in that:

the liquid crystal is ferroelectric liquid crystal;

to one of the simultaneously selected two scanning electrodes, a blanking pulse is applied prior to the selection period and the blanking pulse has a negative polarity, while a strobe pulse is applied during the selection period and the strobe pulse has a positive polarity; and to the other electrode of the simultaneously selected two scanning electrodes, a blanking pulse is applied prior to the selection period and the blanking pulse has a positive polarity, while a strobe pulse is applied during the selection period and the strobe pulse has a negative polarity.

According to the above arrangement, blanking pulses having opposite polarities are applied respectively to the simultaneously selected two scanning electrodes prior to the selection period. Consequently, the pixels belonging to one of the two scanning electrodes are initialized to the light state as one of the two stable states, and the pixels belonging to the other scanning electrode are initialized to the dark state as the other stable state.

Further, since the strobe pulses applied respectively to the above two scanning electrodes during the selection period have opposite polarities, the pixels on both the scanning electrodes can show the same level in response to the identical data voltage at a certain temperature, if the pulse width and peak value of the strobe voltages and a set of waveforms of the data voltage are selected adequately. Consequently, it has become possible to provide a liquid crystal display which can realize stable gray-scale display.

A liquid crystal display of claim 3 is the liquid crystal display set forth in claim 2, further characterized in that the ferroelectric liquid crystal has a minimum value in a characteristics curve of a response time to an applied voltage.

A liquid crystal display of claim 4 is the liquid crystal display set forth in claim 2, further characterized in that waveforms of data voltages respectively corresponding to the light state, dark state, and half-tone display state satisfy three following conditions:

(A) an average of direct current components in each waveform is 0;

(B) a root-mean-square value of each waveform is equal to each other; and (C) a polarity shift of each data voltage is equal to each other.

The switching characteristics of the ferroelectric liquid crystal in the pixel are affected by not only the shape of the main switching pulse (synthetic pulse of the strobe pulse and data voltage), but also the shape of a pre-pulse preceding the switching pulse. When a set of waveforms of the data voltage satisfying the above conditions is used, the switching during the selection period is less affected by the waveforms of the data voltage during the non-selection period (especially before and after the selection period), thereby making stable gray-scale display possible.

A liquid crystal display of claim 3 is the liquid crystal display set forth in claim 2, further characterized in that pulse widths of strobe pulses applied respectively to the simultaneously selected two scanning electrodes during the selection period are different from each other.

When the pulse widths of the strobe pulses applied respectively to the two scanning electrodes are selected adequately in the above manner, all the pixels on the two scanning electrodes can have the same transmittance to the identical data voltage. Consequently, it has become possible to provide a liquid crystal display which can realize stable gray-scale display.

A liquid crystal display of claim 4 is the liquid crystal display set forth in claim 2, further characterized in that peak values of strobe pulses applied respectively to the simultaneously selected two scanning electrodes during the selection period may be different from each other.

When the peak values of the strobe pulses applied respectively to two scanning electrodes are selected adequately in the above manner, all the pixels on the two scanning electrodes can have the same transmittance to the identical data voltage. Consequently, it has become possible to provide a liquid crystal display which can realize stable gray-scale display.

For a fuller understanding of the nature and advantages of the invention, reference should be made to the ensuing detailed description taken in conjunction with the accompanying drawings.

DESCRIPTION OF THE EMBODIMENTS

Referring to FIGS. 1 through 7, the following description will describe an example embodiment of the present invention.

Figure 2:
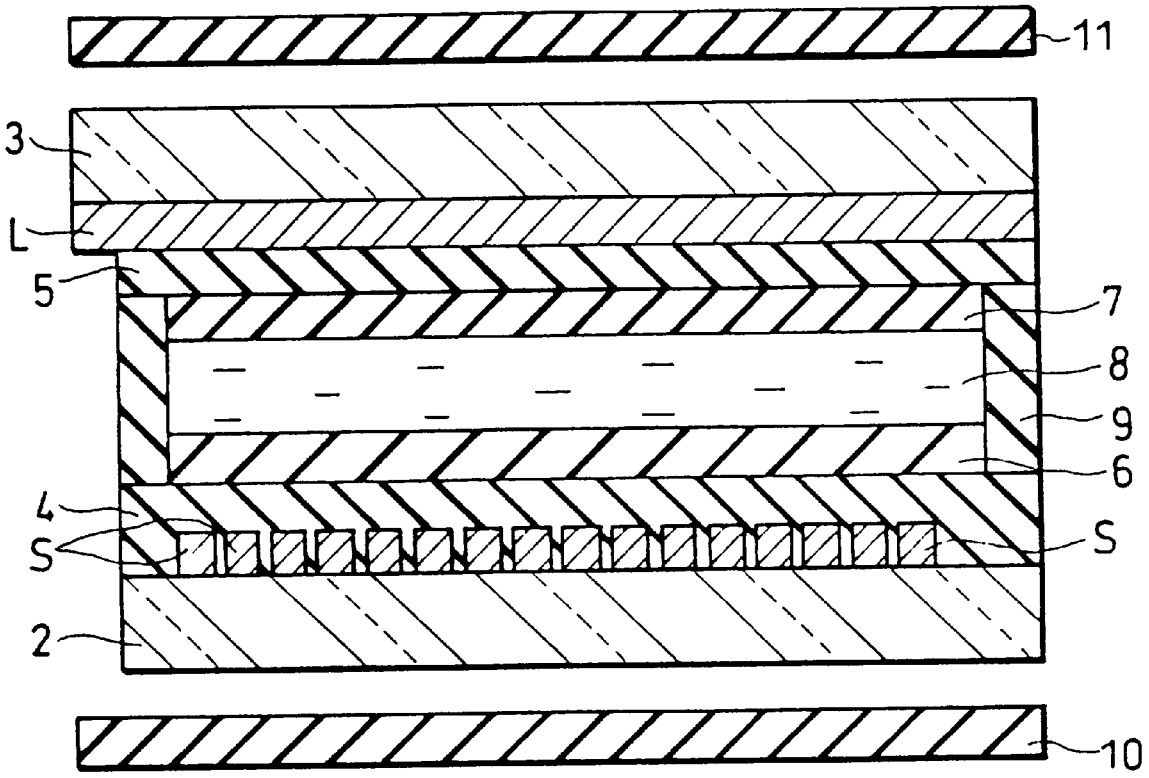
FIG. 2 is a cross section schematically showing an arrangement of a liquid crystal panel provided to the above liquid crystal display.

A liquid crystal display of the present embodiment is a ferroelectric liquid crystal display of a passive matrix type measuring 5.5 inches from the upper left corner to the lower right corner, and has a liquid crystal panel as shown in FIG. 2. The liquid crystal panel includes two transmitting substrates 2 and 3 which oppose each other. The substrates 2 and 3 can be realized by, for example, glass plates.

A plurality of transparent signal electrodes S, made of Indium Tin Oxide (hereinafter, referred to as ITO) or the like, are provided in parallel to each other on the surface of the substrate 2. The signal electrodes S are coated with a transparent insulation film 4 made of silicon oxide ($SiO_2$) or the like.

On the other hand, a plurality of transparent scanning electrodes L, made of ITO or the like, are provided on the surface of the substrate 3 in parallel to each other and perpendicularly to the signal electrodes S. The scanning electrodes L are coated with an insulation film 5 made of the same material as the insulation film 4.

Alignment films 6 and 7, to which the uniaxial alignment treatment such as rubbing is applied, are provided on the insulation films 4 and 5, respectively. For example, polyvinyl alcohol is used as the alignment films 6 and 7.

The substrates 2 and 3 are laminated to each other through a sealing agent 9 in such a manner that the alignment films 6 and 7 provided thereon oppose each other, and ferroelectric liquid crystal 8 is filled in a space between the substrates 2 and 3 to form a liquid crystal layer. The ferroelectric liquid crystal 8 is injected from an unillustrated opening made through the sealing agent 9 and the opening is sealed to encapsulate the ferroelectric liquid crystal 8 in the space.

Two polarizing plates 10 and 11 are provided outside the substrates 2 and 3, respectively, in such a manner that their polarizing axes extend perpendicularly to each other.

A material whose response time characteristics (τ-V characteristics) in response to an applied voltage have a minimum value is used as the ferroelectric liquid crystal 8. Of all the commercially available products, for example, SCE 8 of Merck AG is applicable. It is preferable that the ferroelectric liquid crystal 8 is in the C2U alignment state.

Each pixel shows black (dark) state when a sufficient minus voltage is supplied, and a white (light) state when a sufficient plus voltage is supplied. Further, besides the white display and black display, 2-level half-tone display can be realized as a mixture ratio of a white display domain and a black display domain changes in response to a data voltage. In other words, in the present liquid crystal display, each pixel can show 4-level display. Waveforms or the like of the data voltage to realize the 2-level half-tone display will be described below.

Figure 3:
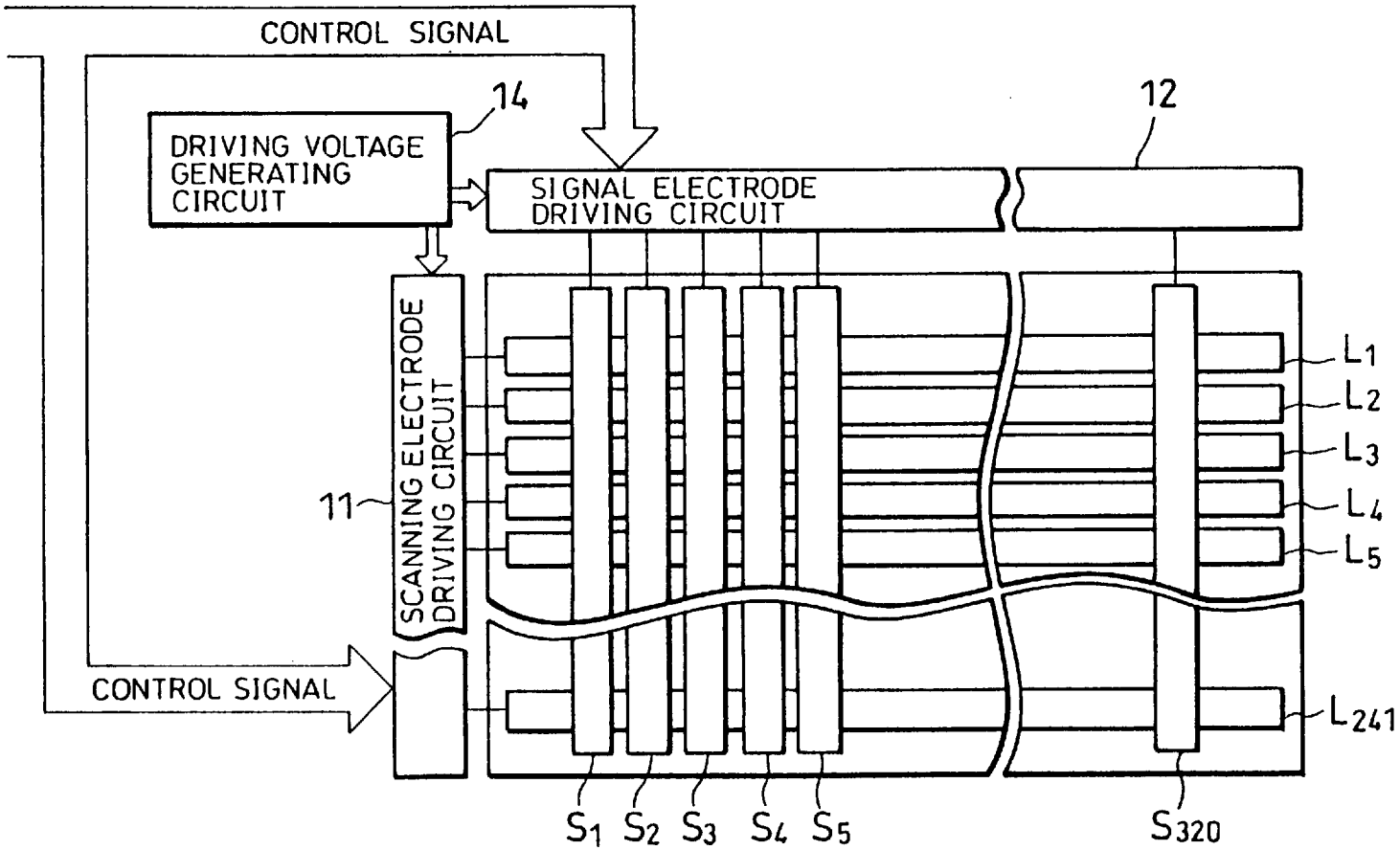
FIG. 3 is a block diagram schematically showing an arrangement of driving mechanism of the above liquid crystal display.

FIG. 3 is a block diagram schematically showing driving mechanism of the liquid crystal display. As shown in the drawing, the liquid crystal display includes 241 parallel scanning electrodes $L_1$, $L_2$, $L_3$, . . . , and $L_{241}$, and 320 parallel signal electrodes $S_1$, $S_2$, $S_3$, . . . , and $S_{320}$, which are aligned perpendicularly to the scanning electrodes. Of all the scanning electrodes, the scanning electrodes $L_2$, $L_3$, . . . , and $L_{240}$ excluding the scanning electrodes $L_1$ and $L_{241}$ are used as the actual effective display area.

A scanning electrode driving circuit 11 and a signal electrode driving circuit 12 are provided to drive the scanning electrodes $L_1$ . . . and signal electrodes $S_1$ . . . , respectively. The scanning electrode driving circuit 11 and signal electrode driving circuit 12 control a driving voltage given from a driving voltage generating circuit 14 based on a control signal from an external block, and apply the driving voltage to the scanning electrodes $L_1$ . . . and signal electrodes $S_1$ . . . as a scanning voltage and a data voltage, respectively.

Figure 1:
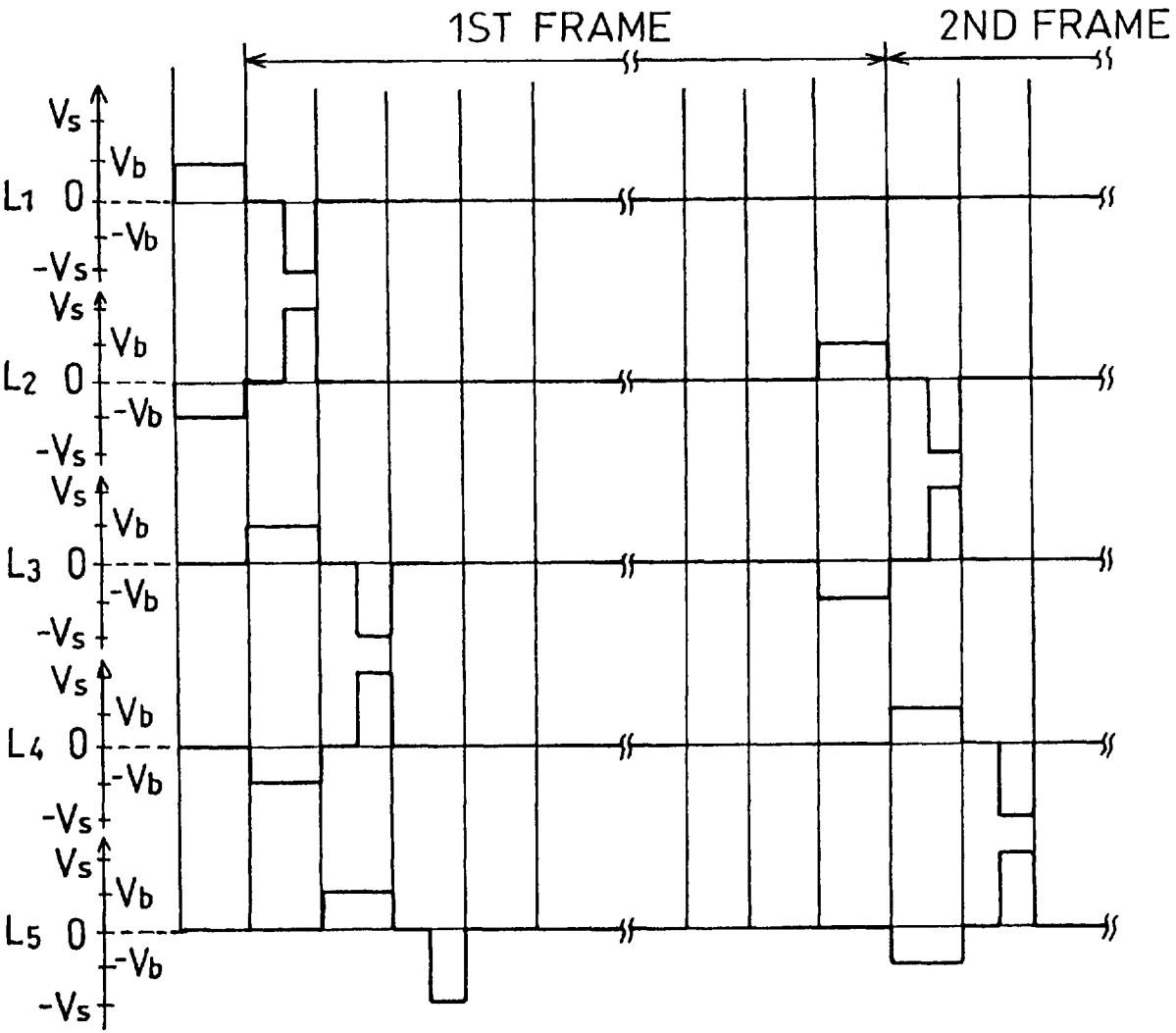
FIG. 1 is a view showing waveforms indicating a scanning voltage applied to a scanning electrode from a scanning electrode driving circuit in a liquid crystal display in accordance with an example embodiment of the present invention.

A waveform of the scanning voltage applied to the scanning electrodes $L_1$, $L_2$, $L_3$, . . . from the scanning electrode driving circuit 11 is illustrated in FIG. 1.

As shown in the drawing, given a first frame and a second frame as two continuous display frames, then two neighboring electrodes $L_1$ and $L_2$ are selected simultaneously in the first frame, and display information is written into the pixels on these scanning electrodes $L_1$ and $L_2$. Here, a strobe pulse applied to the scanning electrode $L_1$ is negative, while a strobe pulse applied to the scanning electrode $L_2$ is positive. In the following selection period, the scanning electrodes $L_3$ and $L_4$ are selected simultaneously, and display information is written into the pixels on these scanning electrodes $L_3$ and $L_4$.

In each of the subsequent selection periods, two neighboring scanning electrodes are selected simultaneously in the combination of the scanning electrodes $L_5$ and $L_6$, and $L_7$ and $L_8$, . . . and $L_{239}$ and $L_{240}$, so that the display information are written into the corresponding pixels sequentially. Note that, however, the scanning electrode $L_{241}$ is not selected in the first frame.

In the second frame, the scanning electrode $L_1$ is not selected, and the scanning electrodes $L_2$ and $L_3$ are selected simultaneously, and the display information is written into the pixels on these scanning electrodes. In the following selection period, the scanning electrodes $L_4$ and $L_5$ are selected simultaneously, and the display information are written into the pixels provided on these scanning electrodes. In each of the subsequent selection periods, two neighboring scanning electrodes are selected simultaneously in the combination of the scanning electrodes $L_6$ and $L_7$, and $L_8$ and $L_9$, . . . , and $L_{240}$ and $L_{241}$, so that the display information are written into the corresponding pixels sequentially.

The scanning electrode driving circuit 11 applies the same scanning voltage as the one used in the first frame in the odd-numbered frame, and applies the same scanning voltage as the one used in the second frame in the even-numbered frame.

In the method adopted in the present embodiment, the scanning electrodes $L_2$ through $L_{240}$ are used as the effective display area, and the scanning electrode $L_{241}$ is not selected in the first frame while the scanning electrode $L_1$ is not selected in the second frame. However, the present invention is not limited to the above arrangement. For example, the following method is also applicable: only the scanning electrode $L_1$ is selected in the first selection period of the first frame, and the scanning electrodes $L_2$ and $L_3$, $L_4$ and $L_5$, . . . , and $L_{240}$ and $L_{241}$ are selected successively in the subsequent selection periods, while in the second frame, the scanning electrodes $L_1$ and $L_2$, $L_3$ and $L_4$, . . . , $L_{239}$ and $L_{240}$ are selected successively, and only the scanning electrode $L_{241}$ is selected in the last selection period of the second frame. The number of the scanning electrodes is not limited to an odd number, and can be an even number.

Next, the scanning voltages applied respectively to the simultaneously selected two scanning electrode will be explained in further detail with reference to FIG. 1. Here, a focus is given to a pair of the scanning electrodes $L_3$ and $L_4$ in the first frame.

As shown in FIG. 1, a plus blanking pulse is applied to the scanning electrode $L_3$ prior to the selection period in the first frame, and a minus strobe pulse is applied to the same during the selection period. Here, all the pixels on the scanning electrode $L_3$ are reset to the white (light) state by the plus blanking pulse. Later, a certain level is written to the pixels on the scanning electrodes $L_3$ by a resultant waveform of the minus strobe pulse and a data voltage.

A pulse width of the blanking pulse is equal to the length of the selection period, while a pulse width of the strobe pulse is half the length of the selection period. Note that the peak value $V_b$ of the blanking pulse is half the peak value $V_s$ of the strobe pulse. In other words, an average of the direct components of the scanning voltage in each frame period is 0.

On the other hand, a minus blanking pulse and a plus strobe pulse are applied to the scanning electrode $L_4$. Here, all the pixels on the scanning electrode $L_4$ are reset to the black (dark) state by the minus blanking pulse. Later, a certain level is written to the pixels on the scanning electrode $L_4$ by a resultant waveform of the plus strobe pulse and data voltage.

If the pulse width and peak value of the strobe pulse, the pulse shape, data voltage waveform, etc. are set adequately, all the pixels on the simultaneously selected two scanning electrodes in the first frame, such as the scanning electrodes $L_3$ and $L_4$, can have the same level to the identical data voltage at a certain temperature.

Figure 4:
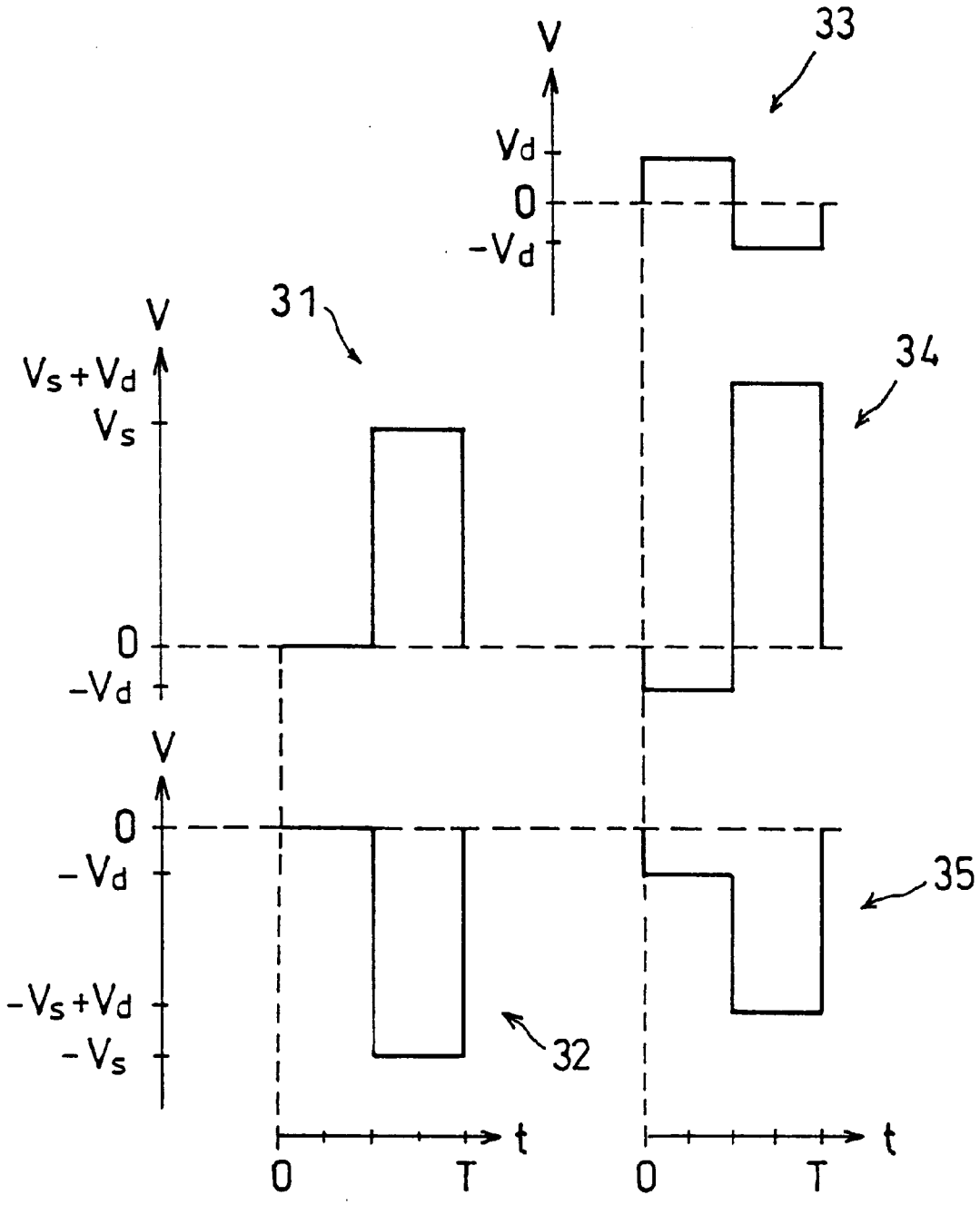
FIG. 4 is a view showing a waveform of a scanning voltage, a waveform of a data voltage, and a waveform of a pixel voltage composed of a combination of the scanning voltage and data voltage, all of which are applied to the simultaneously selected two scanning electrodes during a selection period.
Figure 5A:
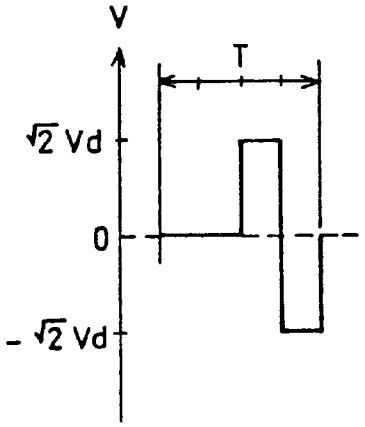
FIGS. 5(*a*) through 5(*d*) are views showing example waveforms of the data voltage corresponding to each level.
Figure 5B:
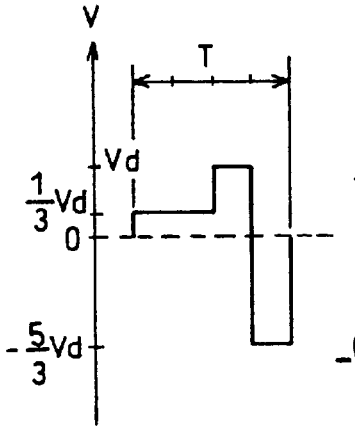
Figure 5C:
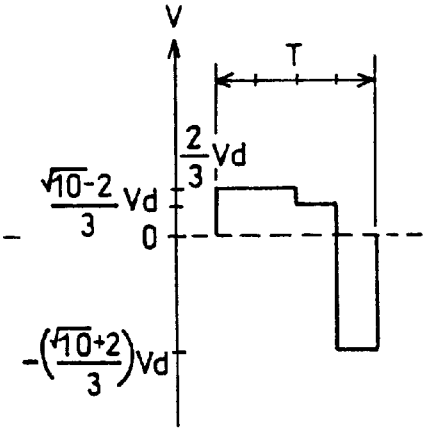
Figure 5D:
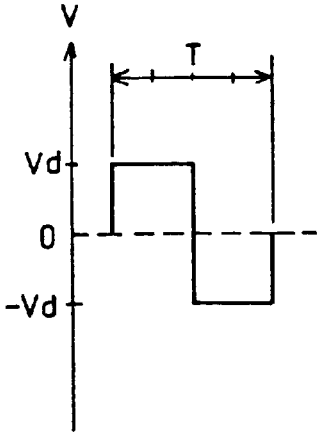

For example, as shown in FIG. 4, assume that scanning voltages 31 and 32 are applied to two neighboring scanning electrodes $L_{2n-1}$ and $L_{2n}$, during one selection period, pixel voltages 34 and 35 having different waveforms are generated respectively on the pixels belonging to the scanning electrode $L_{2n-1}$ and the pixels belonging to the scanning electrode $L_{2n}$ in response to the identical data voltage 33. Here, the length (T) of the selection period is four times as long as a unit period (1 slot).

In the scanning electrode $L_{2n-1}$, the first two slots of the data voltage 33 are of the same polarity as the polarity of the strobe pulse of the scanning voltage 31, and the last two slots are of the opposite polarity to the polarity of the strobe pulse. Thus, the pixel voltage 34, which is a resultant waveform of the data voltage 33 and scanning voltage 31, functions as a waveform with which the display state of the pixel is hard to rewrite (non-rewriting waveform) for the ferroelectric liquid crystal having a minimum value in its $\tau$-V characteristics.

On the other hand, in the scanning electrode $L_{2n}$, the first two slots of the data voltage 33 are of the opposite polarity to the polarity of the strobe pulse, and the last two slots are of the same polarity as the polarity of the strobe pulse. Thus, the pixel voltage 35, which is a resultant waveform of the data voltage 33 and scanning voltage 32, functions as a waveform with which the display state of the pixel is readily rewritten (rewriting waveform) for the ferroelectric liquid crystal having a minimum value in its $\tau$-V characteristics.

In other words, the effects that the identical data voltage 33 gives to the pixels on the scanning electrode $L_{2n-1}$ and to those on the other scanning electrode $L_{2n}$ are completely opposite. On the other hand, the pixels on the scanning electrode $L_{2n-1}$ and those on the other scanning electrode $L_{2n}$ are initialized to the opposite display states (either black state or white state) by the blanking pulses. Consequently, the pixels on the scanning electrode $L_{2n-1}$ and those on the other scanning electrode $L_{2n}$ show the same transmittance when the identical data voltage 33 is applied.

It is preferable to use a set of the driving waveforms of the data voltage that satisfies the three following conditions:

(A) the waveform of the data voltage in response to each level has a DC balance by itself, that is, an average of the direct current components in each waveform is 0;

(B) the root-mean-square value of each data voltage is equal to each other; and (C) the polarity shift of each data voltage is equal to each other, but only the direction of the polarity shift (plus to minus or vice versa) has to be the same, and the timing of the polarity shift does not have to be the same.

When the condition (A) is satisfied, the deterioration of the liquid crystal material can be prevented.

When the condition (B) is satisfied, there can be achieved an effect that the display during the non-selection period is stabilized. To be more specific, the ferroelectric liquid crystal has a trait that the white intensity level in the solid light state and the black intensity level in the solid dark state vary slightly with the root-mean-square value of the waveform of the data voltage applied to the liquid crystal during the non-selection period. This trait is especially noticeable in the ferroelectric liquid crystal having a minimum value in the response time to the applied voltage. This trait is more noticeable in the ferroelectric liquid crystal showing C2 alignment. Thus, if the root-mean-square value of the waveform of the data voltage differs in each waveform, when the same light state is displayed, the intensity varies depending on the types of the waveform of the data voltage applied to the liquid crystal during the non-selection period. However, if the root-mean-square value of each driving waveform of the data voltage is equal to each other, the intensity does not vary regardless of the waveform of the data voltage during the non-selection period, thereby making stable display possible.

When the condition (C) is satisfied, the switching during the selection period is less affected by the waveform of the data voltage during the non-selection period (especially before and after the selection period). The ferroelectric liquid crystal sometimes has a phenomenon that, for example, after the desired level state is written during the selection period, this particular level state can not be maintained and becomes unstable depending on the types of waveform of the data voltage during the non-selection period following the selection period. Moreover, the instability of the level varies with the types of the waveforms, and such instability of the level state is particularly noticeable in the ferroelectric liquid crystal having a minimum value in the characteristic curve of the response time to the applied voltage. This trait is more noticeable in the ferroelectric liquid crystal showing C2 alignment. In contrast, if a set of the waveforms of the data voltage satisfying the condition (C) is used, the occurrence of such an unwanted phenomenon, that is, unstable level state, can be suppressed markedly.

Here, an example set of the waveforms of the data voltage satisfying all the conditions (A), (B), and (C) will be explained. Each pixel of the liquid crystal panel of the present embodiment can show 4-level display: white (light) display state, black (dark) display state, half-tone display state of two levels. A set of waveforms corresponding to these four levels are shown in FIGS. 5(*a*) through 5(*d*) as the set of the waveforms of the data voltage satisfying all the conditions (A), (B), and (C).

To be more specific, each waveform of the data voltage shown in FIGS. 5(*a*) through 5(*d*) has the DC balance and the same root-mean-square value. In addition, as the comparison among these four waveforms reveals, each waveform shifts to the negative polarity from the positive polarity, meaning that they shift the polarities in the same manner. However, the timing of the polarity shifting does not have to be the same.

The waveform shown in FIG. 5(*a*) can be the rewriting waveform that switches the display state of the pixel when combined with the positive strobe pulse, while it can be the non-rewriting waveform that maintains the current display state of the pixel when combined with the negative strobe pulse. The waveform shown in FIG. 6 can be used as the strobe pulse.

Figure 6:
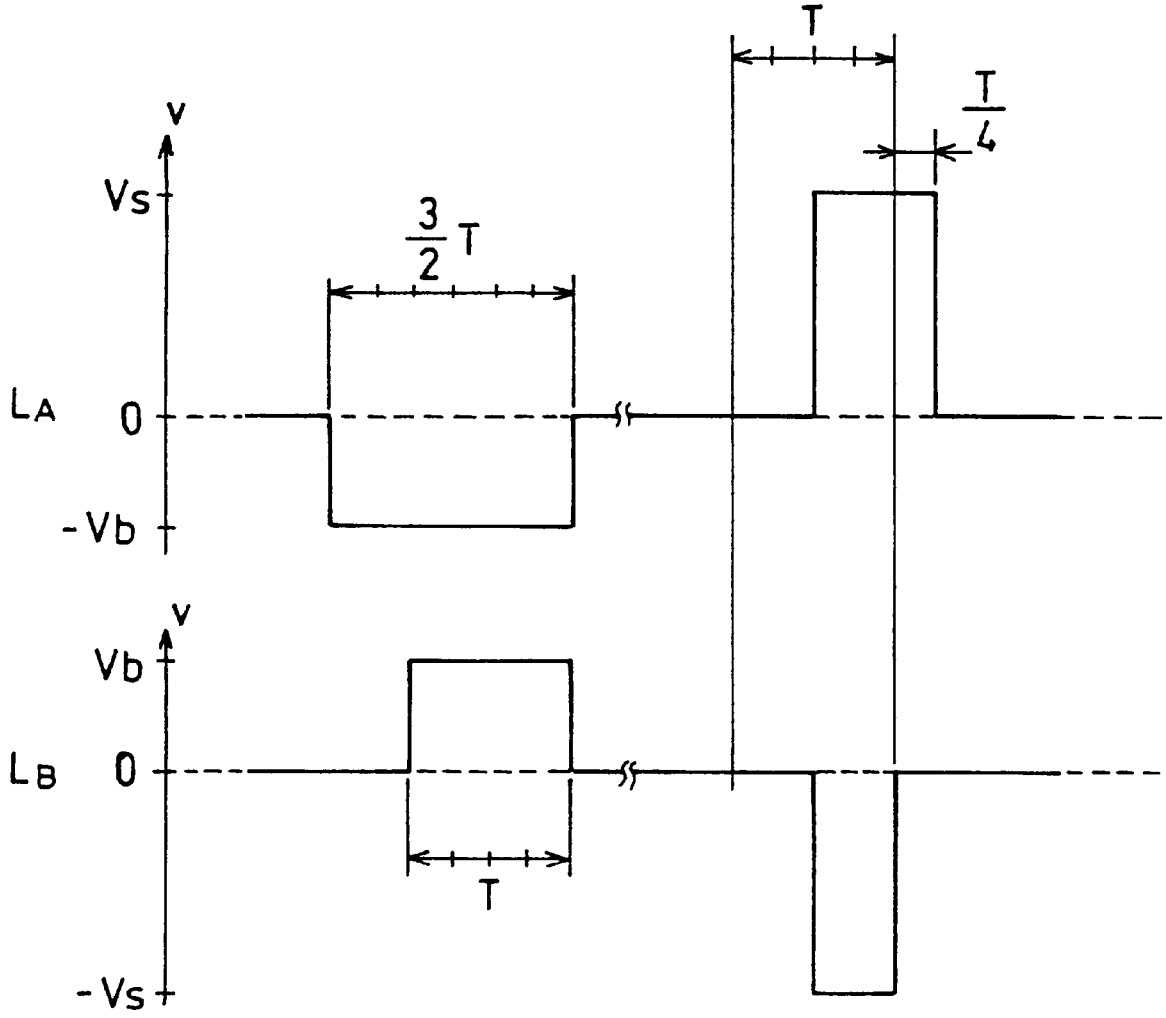
FIG. 6 is a view showing a waveform of a modified example of the scanning voltage applied to simultaneously selected two scanning electrodes.

The waveform shown in FIG. 5(*b*) creates a state where the black display domain and white display domain coexist within a pixel when combined with the waveform of the scanning voltage of FIG. 6. Here, a coexistence ratio of the black display domain to the white display domain is about 1:2, so that about 65% of half-tone state is obtained, provided that the solid white state is 100%.

The waveform shown in FIG. 5(*c*) creates a state where the black display domain and white display domain coexist within a pixel when combined with the waveform of the scanning voltage of FIG. 6. Here, a coexistence ratio of the black display domain to the white display domain is about 2:1, so that about 30% of half-tone state is obtained, provided that the solid white state is 100%.

The waveform shown in FIG. 5(*d*) can be the non-rewriting waveform that maintains the current display state of the pixel when combined with the positive strobe pulse as shown in FIG. 6, while it can be the rewriting waveform that switches the display state of the pixel when combined with the negative strobe pulse.

With the waveform of the scanning voltage shown in FIG. 6, a strobe pulse having a pulse width for three slots, that is, the last two slots of the selection period and one slot right after the selection period, is applied to the scanning electrode $L_A$. On the other hand, a strobe pulse is applied to the scanning electrode $L_B$ only for the last two slots of the selection period.

The peak value $V_b$ of the blanking pulse applied to the scanning electrode $L_A$ is half the peak value $V_s$ of the strobe pulse, and the pulse width of the blanking pulse is one and half (3/2) time of the length of the selection period. On the other hand, the pulse width of the blanking pulse applied to the scanning electrode $L_B$ is equal to the length T of the selection period.

Besides the above arrangements, it is effective to give different peak values to the strobe pulses supplied to the simultaneously selected two scanning electrode to obtain the same transmittance on all the pixels on these two scanning electrodes in response to the identical data voltage.

As has been explained, in the liquid crystal display of the present embodiment, it is arranged that two scanning electrodes are sequentially selected in each frame. Thus, the actual display resolution within one frame is reduced to half from the original.

However, if the combination of the simultaneously selected two scanning electrodes is changed in each frame as been explained, the display resolution visible to human eyes can be improved without increasing the number of the electrodes. Consequently, it has become possible to obtain stable gray-scale display which has no flicker and its transmittance does not vary with a change in temperature over the entire panel.

An experiment is conducted using the liquid crystal display of the present embodiment, in which the ambient temperature is changed while applying a data voltage such that can give the transmittance of about 45% at 25° C. Then, as indicated by Graph A in FIG. 7, an effect that the transmittance hardly varies in response to the temperature change of ±1° C. is confirmed. The temperature variance in the panel at this point is about ±0.8° C.

A ferroelectric liquid crystal panel similar to the liquid crystal display of the present embodiment is driven in the conventional manner for the purpose of comparison. To be more specific, in the first frame of two continuous frames, the scanning electrodes in the first and second lines are selected simultaneously in the first selection period to write the display information, and to do so, the strobe pulses having the same polarity, peak value, pulse width, and waveform, are applied to both the scanning electrodes simultaneously.

In the following selection period, the scanning electrodes in the third and fourth lines are selected simultaneously, and subsequently, two scanning electrodes in the fifth and sixth, the seventh and eighth, . . . are sequentially selected simultaneously, and written with the display information by the application of the identical strobe voltages.

After all the scanning electrodes are selected in the above manner in the first frame, then in the second frame, the first line is not selected, and two scanning electrodes are selected sequentially in a different combination from the combination in the first frame, that is, the second and third lines, fourth and fifth lines, . . . . In the second frame, the strobe pulses having the same polarity, peak value, pulse width, and waveform are also applied to the simultaneously selected two scanning electrodes.

Figure 7:
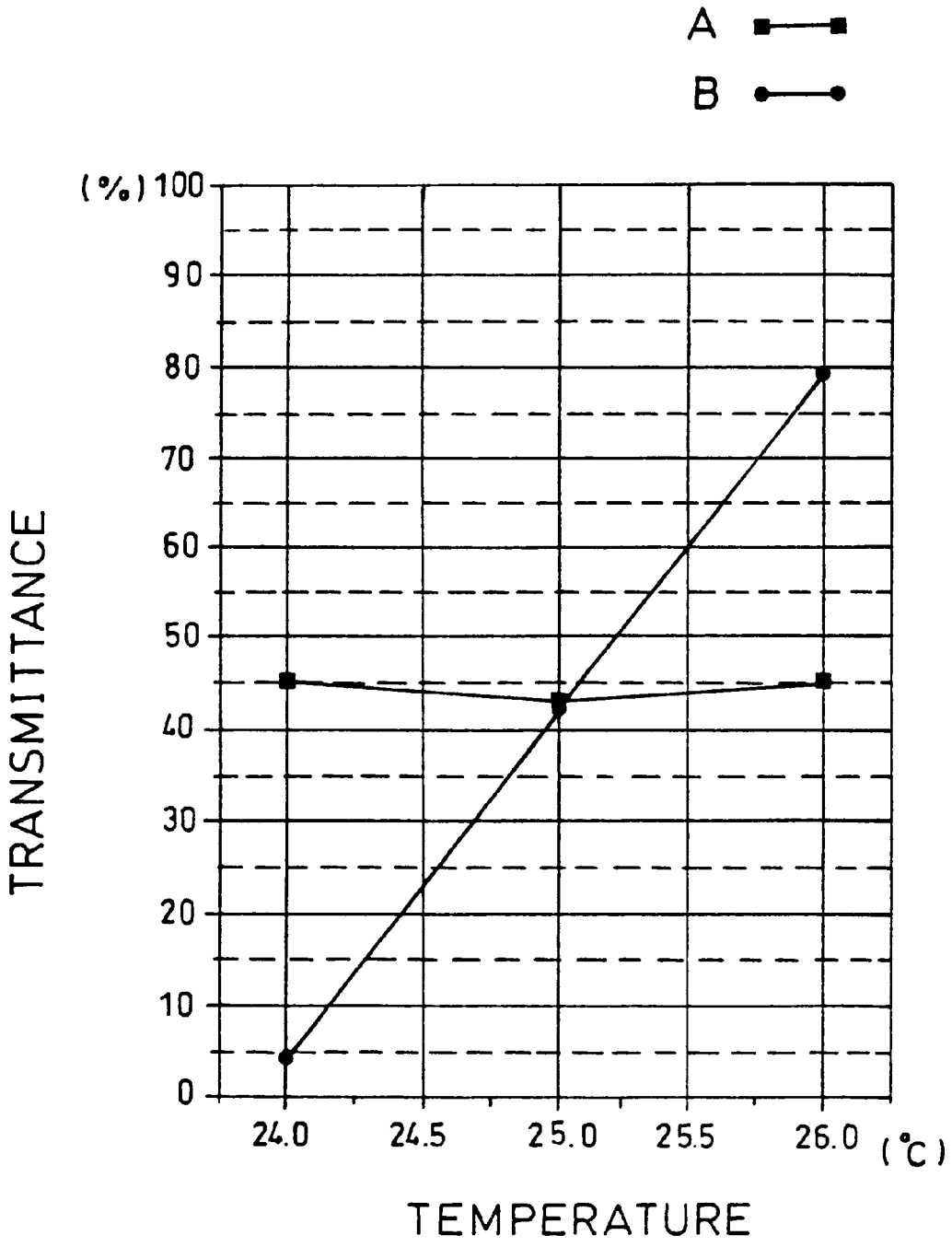
FIG. 7 is a graph showing a temperature dependency of optical response characteristics (transmittance) of the above liquid crystal display with temperature compensation as a comparison with an example with no compensation.
Figure 8:
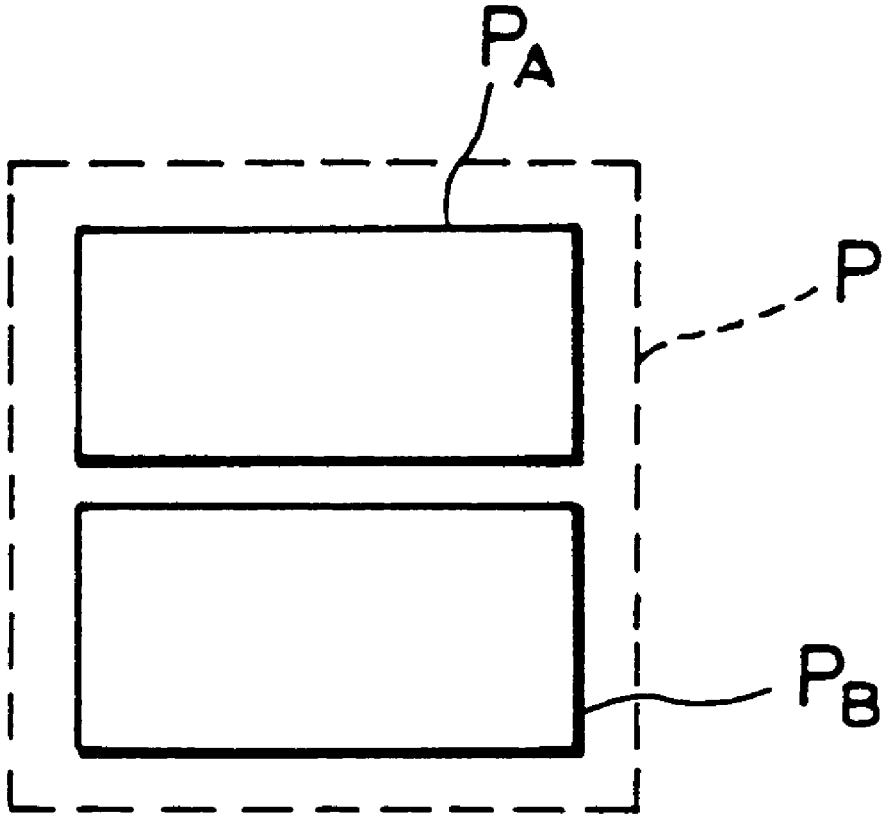
FIG. 8 is a view explaining an example pixel arrangement for realizing the gray-scale including the half-tone in a conventional ferroelectric liquid crystal display.
Figure 9:
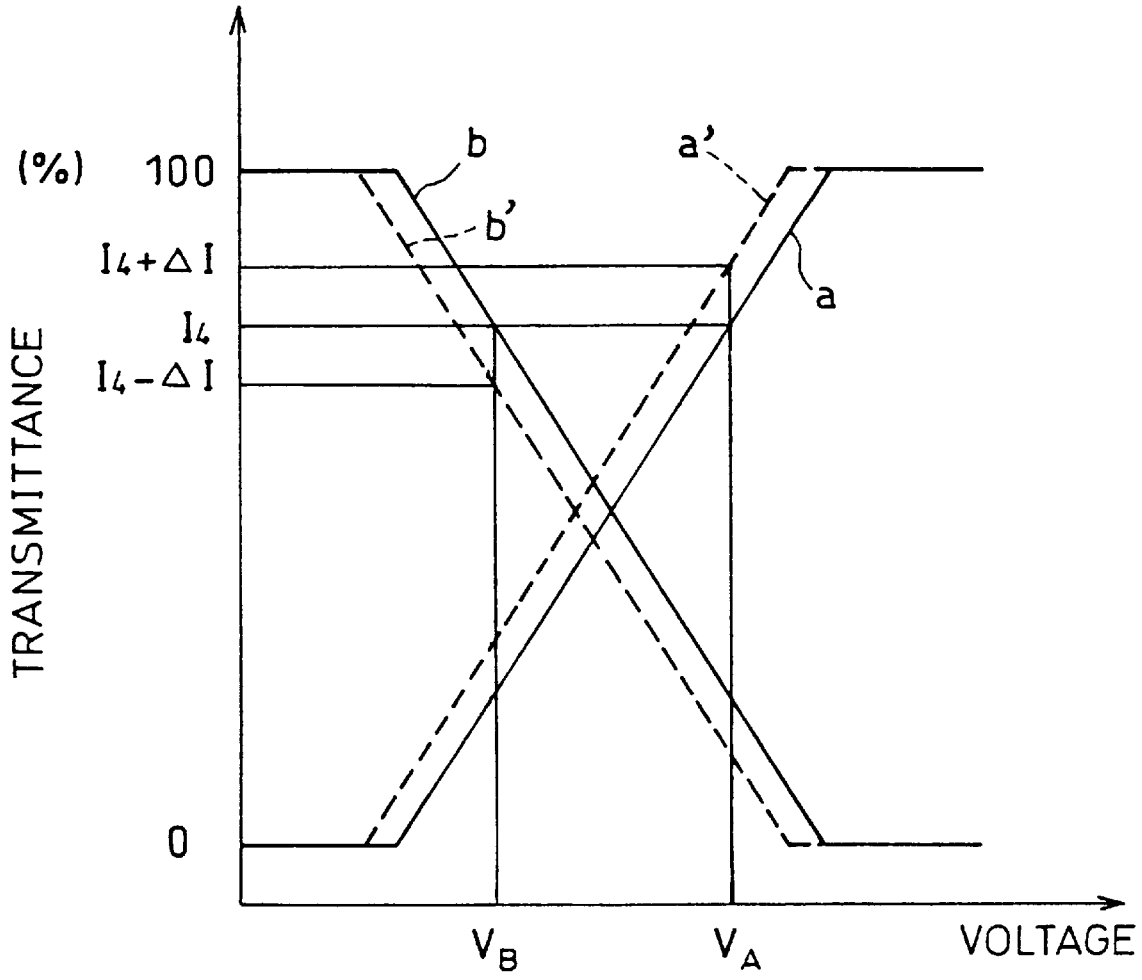
FIG. 9 is a graph showing how the optical response characteristics shift in response to a change in temperature in the conventional ferroelectric liquid crystal display.

In the comparative example, the change of the transmittance caused by the temperature variance in the panel is not cancelled out, and as indicated by Graph B in FIG. 7, the transmittance varies considerably in response to a temperature change of ±1° C. The temperature variance measured in the panel is about ±0.8° C.

Thus, it is understood that liquid crystal display of the present embodiment can reduce the variance of the transmittance to a very low level when the temperature in the panel varies due to the change in ambient temperature compared with the prior art, thereby making the stable gray-scale display possible. In the same manner, the present invention may be available for compensation of other characteristics distribution in the panel, for example, thickness variation of liquid crystal layer.

Further, in the liquid crystal display of the present embodiment, it is not necessary to form one pixel from a plurality of sub-pixels as is in the prior art. Thus, the number of the electrodes does not have to be increased, nor the electrode does not have to be narrowed. Consequently, there can be attained an effect that a liquid crystal display realizing stable gray-scale display can be provided without increasing the manufacturing costs.

The present invention is not limited to the above example embodiment, and can be modified in various manners within the scope of the present invention.

That is, a ferroelectric liquid crystal display of the passive matrix type is used as an example liquid crystal display of the present invention, but the present invention can be applied to a liquid crystal display of a TFT driving type. Further, the liquid crystal is not limited to the ferroelectric liquid crystal.

In addition, the waveforms of the scanning voltage and signal voltage are not limited to those explained above, and waveforms of various types can be used depending on the number of levels or the like.

Furthermore, when the present invention is combined with the temporal dither or spatial dither method, display with a greater number of levels can be realized.

As has been explained, a liquid crystal display of the present embodiment is arranged in such a manner that:

given a natural number "n", then, of continuous first and second frames, a scanning electrode in a (2n−1)'th line and a scanning electrode in a 2n'th line are simultaneously selected in the first frame, and the scanning electrode in the 2n'th line and a scanning electrode in a (2n+1)'th line are simultaneously selected in the second frame; and scanning voltages are applied respectively to the simultaneously selected two scanning electrodes during a selection period, the scanning voltages shifting optical response characteristics of pixels on the respective scanning electrodes to an identical data voltage in directions opposite to each other in response to a change in temperature.

Accordingly, the shifts of the optical response characteristics caused by the change in temperature are cancelled out on the simultaneously selected two neighboring scanning electrodes. Thus, variance of the optical response characteristics of the liquid crystal display in response to a change in ambient temperature or the like can be suppressed. Also, by changing the combination of the simultaneously selected two scanning electrode in each frame, the display resolution visible to human eyes can be improved without increasing the number of the electrodes. Consequently, there can be attained an effect that satisfactory gray-scale display without flicker is realized without increasing the manufacturing costs.

Also, the liquid crystal display of the present embodiment is arranged in such a manner that:

the liquid crystal is ferroelectric liquid crystal;

to one of the simultaneously selected two scanning electrodes, a blanking pulse is applied prior to the selection period and the blanking pulse has a negative polarity, while a strobe pulse is applied during the selection period and the strobe pulse has a positive polarity; and to the other electrode of the simultaneously selected two scanning electrodes, a blanking pulse is applied prior to the selection period and the blanking pulse has a positive polarity, while a strobe pulse is applied during the selection period and the strobe pulse has a negative polarity.

Accordingly, the pixels on both the scanning electrodes show the same level in response to the identical voltage. Consequently, there can be attained an effect that a liquid crystal display realizing further stable gray-scale display is provided.

In addition, it is preferable that the liquid crystal display of the present embodiment is arranged in such a manner that the ferroelectric liquid crystal has a minimum value in a characteristics curve of a response time to an applied voltage.

Accordingly, the pixels on both the scanning electrodes show the same level in response to the identical voltage. Consequently, there can be attained an effect that a liquid crystal display realizing further stable gray-scale display is provided.

Further, it is preferable that the liquid crystal display of the present embodiment is arranged in such a manner that waveforms of data voltages respectively corresponding to the light state, dark state, and half-tone display state satisfy three following conditions:

(A) an average of direct current components in each waveform is 0;

(B) a root-mean-square value of each waveform is equal to each other; and (C) a polarity shift of each data voltage is equal to each other.

Accordingly, the switching during the selection period is less affected by the waveforms of the data voltage during the non-selection period (especially before and after the selection period), thereby attaining an effect that further stable gray-scale display is realized.

Furthermore, the liquid crystal display of the present embodiment may be arranged in such a manner that pulse widths of strobe pulses applied respectively to the simultaneously selected two scanning electrodes during the selection period are different from each other.

Accordingly, there can be attained an effect that a liquid crystal display realizing further stable gray-scale display is provided.

Also, the liquid crystal display of the present embodiment may be arranged in such a manner that peak values of strobe pulses applied respectively to the simultaneously selected two scanning electrodes during the selection period are different from each other.

Accordingly, there can be attained an effect that a liquid crystal display realizing further stable gray-scale display is provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display, in which each pixel can be in at least one half-tone display state in addition to a light state and a dark state, characterized in that:

given a natural number "n", then, of continuous first and second frames, a scanning electrode in a (2n−1)'th line and a scanning electrode in a 2n'th line are simultaneously selected in said first frame, and the scanning electrode in the 2n'th line and a scanning electrode in a (2n+1)'th line are simultaneously selected in said second frame; and scanning voltages are applied respectively to said simultaneously selected two scanning electrodes during a selection period, said scanning voltages shifting optical response characteristics of pixels on said respective scanning electrodes to an identical data voltage in directions opposite to each other in response to a change in temperatures, wherein said liquid crystal is ferroelectric liquid crystal;

to one of said simultaneously selected two scanning electrodes, a blanking pulse is applied prior to the selection period and said blanking pulse has a negative polarity, while a strobe pulse is applied during the selection period and said strobe pulse has a positive polarity; and to the other electrode of said simultaneously selected two scanning electrodes, a blanking pulse is applied prior to the selection period and said blanking pulse has a positive polarity, while a strobe pulse is applied during the selection period and said strobe pulse has a negative polarity; and wherein waveforms of data voltages respectively corresponding to said light state, dark state, and half-tone display state satisfy three conditions as follows:

(A) an average of direct current components in each waveform is 0;

(B) a root-mean-square value of each waveform is equal to each other; and (C) the directions of all polarity shifts of the waveforms are equal to each other.

2. The liquid crystal display of claim 1, wherein said ferroelectric liquid crystal has a minimum value in a characteristics curve of a response time to an applied voltage.

3. The liquid crystal display of claim 1, wherein pulse widths of strobe pulses applied respectively to said simultaneously selected two scanning electrodes during the selection period are different from each other.

4. The liquid crystal display of claim 1, wherein peak values of strobe pulses applied respectively to said simultaneously selected two scanning electrodes during the selection period are different from each other.

* * * * *